US006701620B2

(12) United States Patent
Huang

(10) Patent No.: US 6,701,620 B2
(45) Date of Patent: Mar. 9, 2004

(54) STRING CUTTER

(76) Inventor: Chun Po Huang, No.41, Lane 120, Wenshinnan 3rd Rd., Nantuen Chiu, Taiching (TW), 408

( * ) Notice: Subject to any disclaimer, the term of this patent is extended or adjusted under 35 U.S.C. 154(b) by 38 days.

(21) Appl. No.: 10/151,849

(22) Filed: May 22, 2002

(65) Prior Publication Data

US 2003/0217471 A1 Nov. 27, 2003

(51) Int. Cl.[7] ..... B26B 3/00
(52) U.S. Cl. ..... 30/116; 30/312; 30/520
(58) Field of Search ..... 30/312, 313, 520, 30/340, 342, 116; D8/107

(56) References Cited

U.S. PATENT DOCUMENTS 287,790 A * 11/1883 Atkins ..... 30/520
2,749,949 A * 6/1956 De La Tramerye ..... 30/520
3,310,082 A * 3/1967 De La Tramerye ..... 30/116
4,995,153 A * 2/1991 Asbery ..... 30/116
D475,601 S * 6/2003 Huang ..... D8/107

* cited by examiner

*Primary Examiner*—Hwei-Siu C. Payer
(74) *Attorney, Agent, or Firm*—Rosenberg, Klein & Lee

(57) ABSTRACT

A string cutter includes two handles, two fixing devices, and a cutting string. The cutting string has two ends each secured on the respective handle by the respective fixing device. Each of the two handles includes a loop-shaped handgrip for insertion and holding of a user's fingers. The handgrip has two sides each provided with a protection rib, for encompassing and protecting the user's fingers received in the handgrip. Thus, when the cutting string is broken due to wear or excessive pull and is sprung toward the handles, the broken cutting string will be blocked and stopped by the protection rib of each of the two handles, thereby efficiently preventing the broken cutting string from injuring the user's fingers, so as to protect the user's safety.

6 Claims, 5 Drawing Sheets

STRING CUTTER

BACKGROUND OF THE INVENTION

1. Field of the Invention

The present invention relates to a string cutter, and more particularly to a string cutter for cutting the silica-gel of the glass, wherein when the cutting string is broken, the broken cutting string will be blocked and stopped by the protection rib, thereby efficiently preventing the broken cutting string from injuring the user's fingers, so as to protect the user's safety.

2. Description of the Related Art

A conventional string cutter in accordance with the prior art shown in FIG. 5 comprises two handles 5 each having a fixing rod 50, and a cutting string 6 having two ends each secured on to the fixing rod 50 of one of the two handles 5. In operation, when the user wishes to detach the fixing silica gel 70 of the glass 7, the cutting string 6 is passed through the fixing silica gel 70 around the periphery of the glass 7. Then, each of the two ends of the cutting string 6 may be mounted and secured on to the fixing rod 50 of the respective handle 5. Thus, the user's two hands may hold the two handles 5 to exert a sideward force on the periphery of the glass 7, so that the cutting string 6 may produce a cutting force to cut the fixing silica gel 70 around the periphery of the glass 7. After the cutting string 6 is moved around a circle of the periphery of the glass 7, the fixing silica gel 70 around the periphery of the glass 7 may be cut off entirely, so that the glass 7 may be removed easily. However, the cutting string 6 is easily worn out during a long-term utilization or broken due to excessive pull. Thus, when the cutting string 6 is broken due to wear or excessive pull and is sprung toward the handles 5, the broken cutting string 6 easily touch and hurt the user's fingers, thereby causing danger to the user.

SUMMARY OF THE INVENTION

The present invention has arisen to mitigate and/or obviate the disadvantage of the conventional string cutter.

The primary objective of the present invention is to provide a string cutter, wherein when the cutting string is broken due to wear or excessive pull and is sprung toward the handles, the broken cutting string will be blocked and stopped by the protection rib of each of the two handles, thereby efficiently preventing the broken cutting string from injuring the user's fingers, so as to protect the user's safety.

In accordance with the present invention, there is provided a string cutter, comprising two handles, two fixing devices, and a cutting string, wherein:

- the cutting string has two ends each secured on one of the two handles by one of the two fixing devices;
- each of the two handles includes a loop-shaped handgrip for insertion and holding of a user's fingers, the handgrip of each of the two handles has two sides each provided with a protection rib, for encompassing and protecting the user's fingers received in the handgrip.

Further benefits and advantages of the present invention will become apparent after a careful reading of the detailed description with appropriate reference to the accompanying drawings.

DETAILED DESCRIPTION OF THE INVENTION

Figure 1:
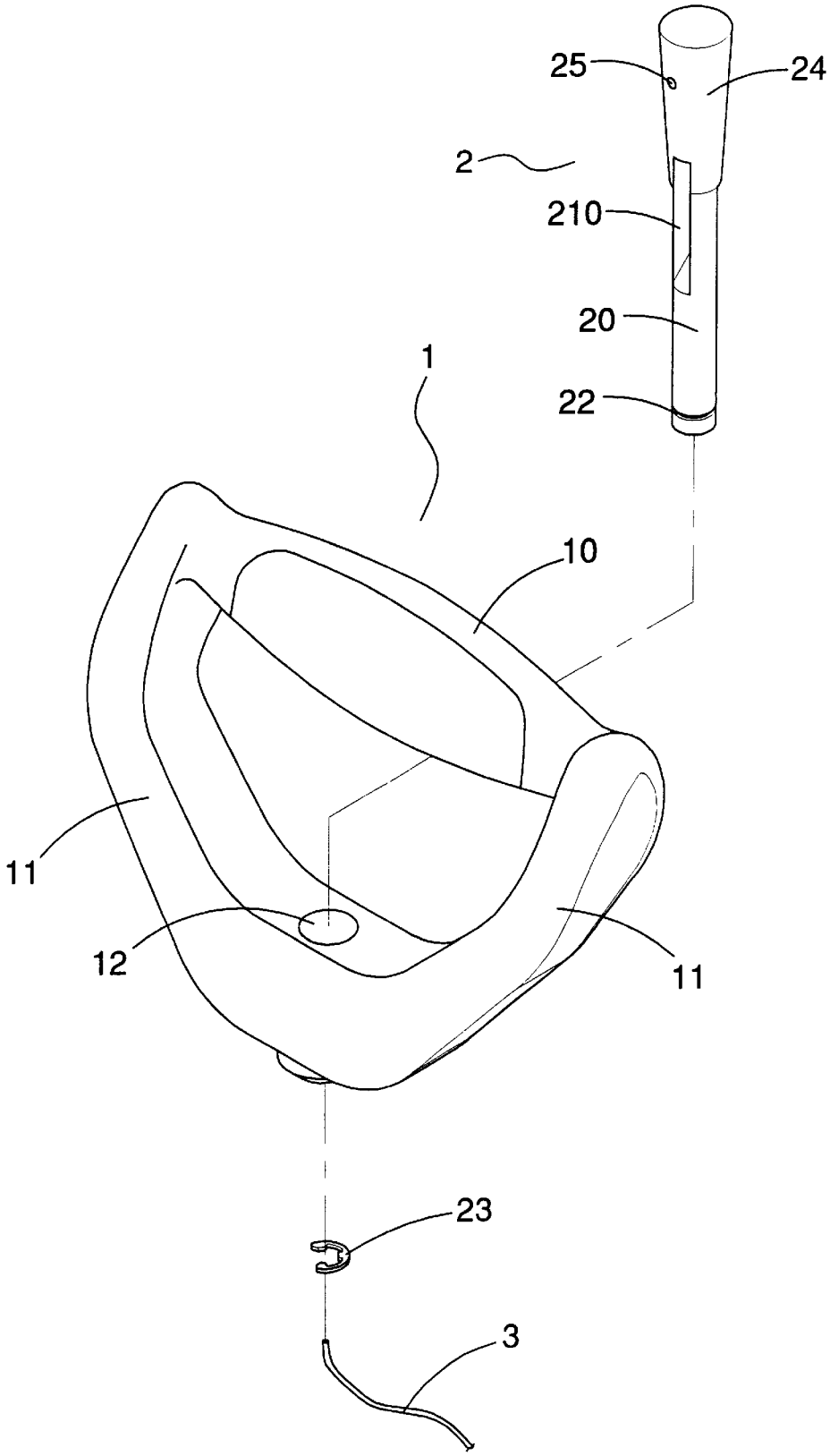
FIG. 1 is an exploded perspective view of a string cutter in accordance with a preferred embodiment of the present invention.
Figure 2:
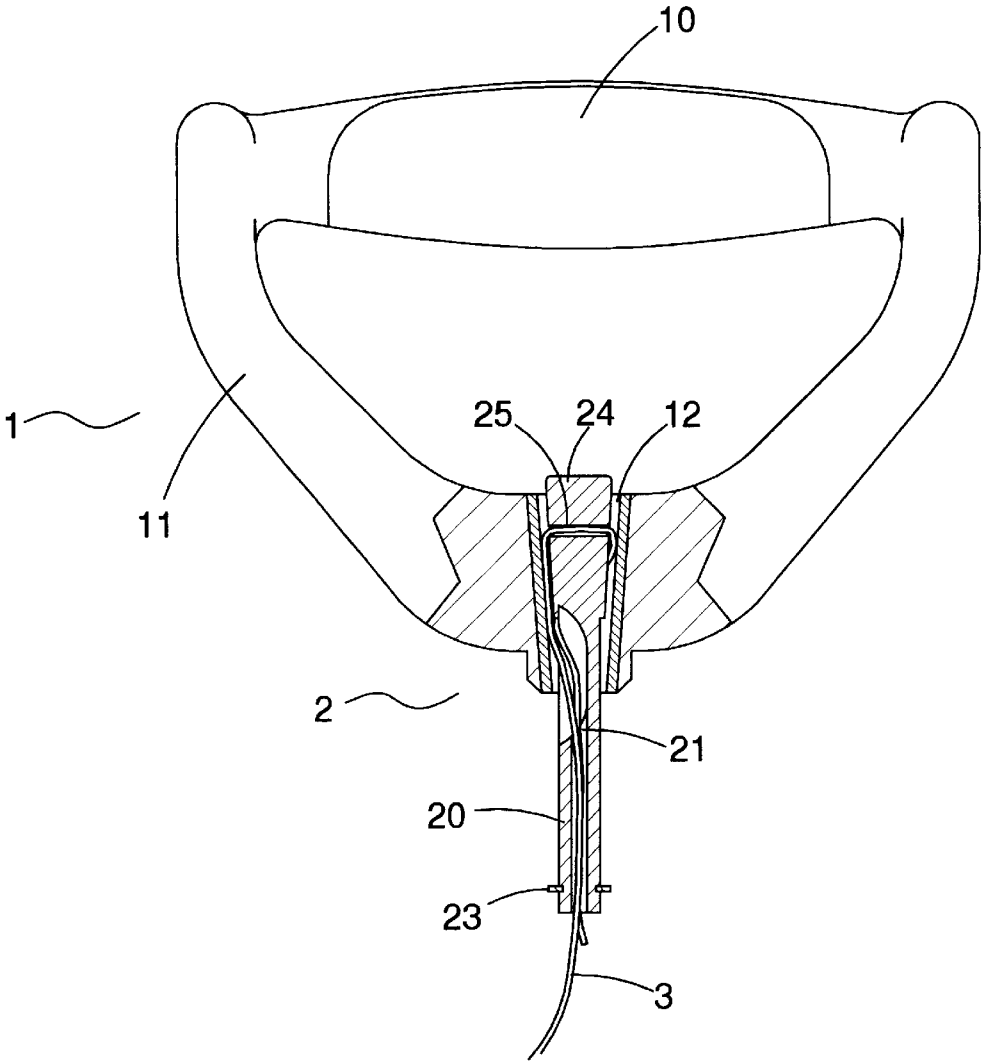
FIG. 2 is a side plan cross-sectional assembly view of the string cutter as shown in FIG. 1.
Figure 3:
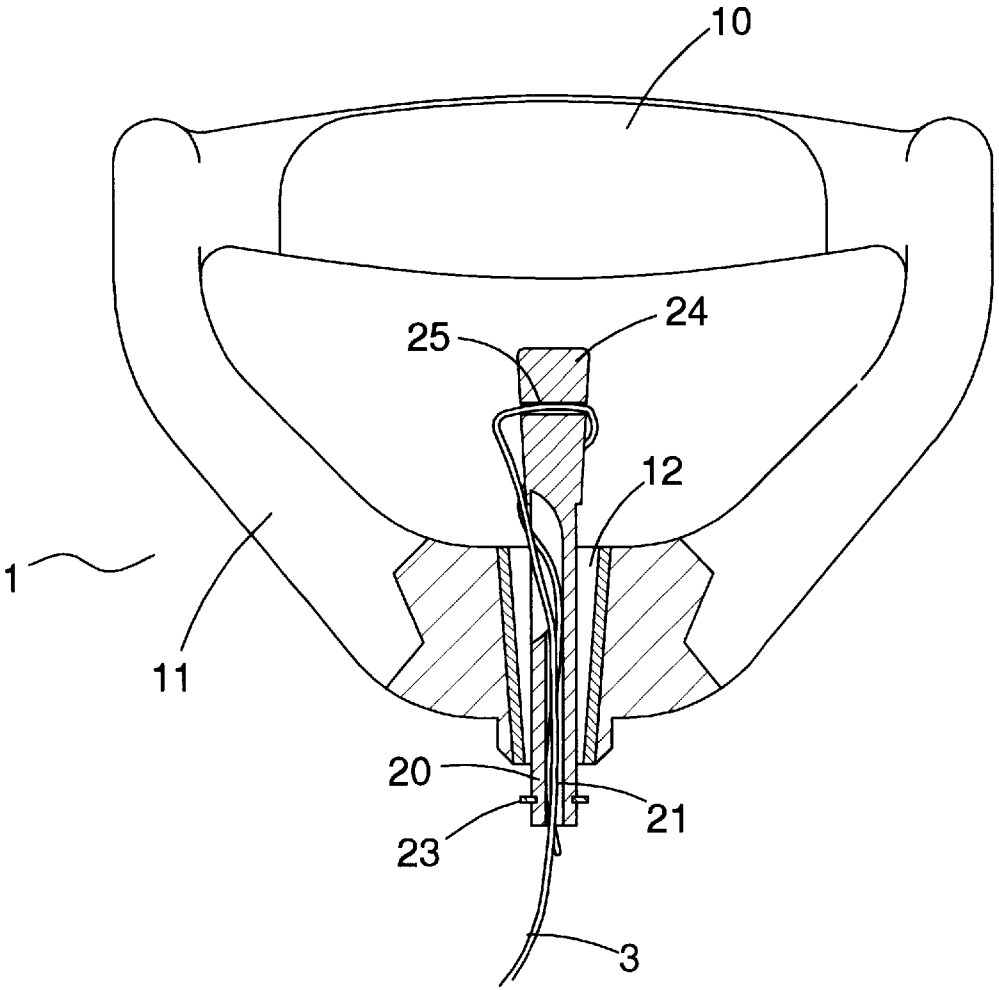
FIG. 3 is a schematic operational view of the string cutter as shown in FIG. 2 in use.

Referring to the drawings and initially to FIGS. 1–3, a string cutter in accordance with a preferred embodiment of the present invention comprises two handles 1, two fixing devices 2, and a cutting string 3.

Each of the two handles 1 is secured on one of the two ends of the cutting string 3 by one of the two fixing devices 2. Each of the two handles 1 includes a loop-shaped handgrip 10 for insertion and holding of the user's fingers. The handgrip 10 of each of the two handles 1 has two sides each provided with a protection rib 11, for encompassing and protecting the user's fingers inserted into the handgrip 10. The handgrip 10 of each of the two handles 1 is formed with a tapered through hole 12.

Each of the fixing devices 2 includes a fixing rod 20 secured in the through hole 12 of the handgrip 10 of one of the two handles 1. The fixing rod 20 of each of the fixing devices 2 has a first end having an inner wall formed with a passage 21, a mediate portion having a periphery formed with an opening 210 which communicates with the passage 21, and a second end provided with a tapered urging portion 24 which is formed with a through hole 25.

The first end of the fixing rod 20 of each of the fixing devices 2 is protruded outward from the through hole 12 of the handgrip 10 of the respective handle 1, and has an outer wall formed with an annular groove 22 for mounting a C-shaped snap ring 23, thereby preventing the first end of the fixing rod 20 of each of the fixing devices 2 from detaching from the through hole 12 of the handgrip 10 of the respective handle 1.

The urging portion 24 of each of the fixing devices 2 has an outer diameter greater than that of the fixing rod 20 of each of the fixing devices 2. The tapered urging portion 24 of each of the fixing devices 2 may be forced into the tapered through hole 12 of the handgrip 10 of the respective handle 1 in a close fit manner, for clamping and securing the cutting string 31 as shown in FIG. 2.

Each of the two ends of the cutting string 3 is secured on the handgrip 10 of the respective handle 1 by the urging portion 24 of the respective fixing device 2.

As shown in FIG. 3, each of the two ends of the cutting string 3 is initially extended through the passage 21 into the opening 210 of the fixing rod 20 of the respective fixing device 2, then protruded outward from the opening 210 of the fixing rod 20 of the respective fixing device 2, then extended through the through hole 25 of the urging portion 24 of the respective fixing device 2, and then extended through the opening 210 into the passage 21 of the fixing rod 20 of the respective fixing device 2, so that each of the two ends of the cutting string 3 may be secured in the through hole 12 of the handgrip 10 of the respective handle 1 by the urging portion 24 of the respective fixing device 2.

In assembly, referring to FIGS. 2 and 3 with reference to FIG. 1, the first end of the fixing rod 20 of each of the fixing devices 2 may be pushed backward, so that the tapered urging portion 24 of each of the fixing devices 2 may be detached from the tapered through hole 12 of the handgrip 10 of the respective handle 1 as shown in FIG. 3.

Then, each of the two ends of the cutting string 3 is extended through the passage 21 into the opening 210 of the fixing rod 20 of the respective fixing device 2, then protruded outward from the opening 210 of the fixing rod 20 of the respective fixing device 2, then extended through the through hole 25 of the urging portion 24 of the respective fixing device 2, and then extended through the opening 210 into the passage 21 of the fixing rod 20 of the respective fixing device 2 as shown in FIG. 3.

Then, the tapered urging portion 24 of each of the fixing devices 2 may be forced into the tapered through hole 12 of the handgrip 10 of the respective handle 1 in a close fit manner as shown in FIG. 2, so that each of the two ends of the cutting string 3 may be secured in the through hole 12 of the handgrip 10 of the respective handle 1 by the fixing rod 20 and the urging portion 24 of the respective fixing device 2, thereby securing each of the two ends of the cutting string 3 on the respective handle 1.

In addition, when the cutting string 30 needs to be replaced, the first end of the fixing rod 20 of each of the fixing devices 2 may be pushed backward, so that the tapered urging portion 24 of each of the fixing devices 2 may be detached from the tapered through hole 12 of the handgrip 10 of the respective handle 1 as shown in FIG. 3, thereby releasing the clamping force of the fixing rod 20 and the urging portion 24 of the respective fixing device 2 on each of the two ends of the cutting string 3, so that each of the two ends of the cutting string 3 may be pulled out for replacement.

Figure 4:
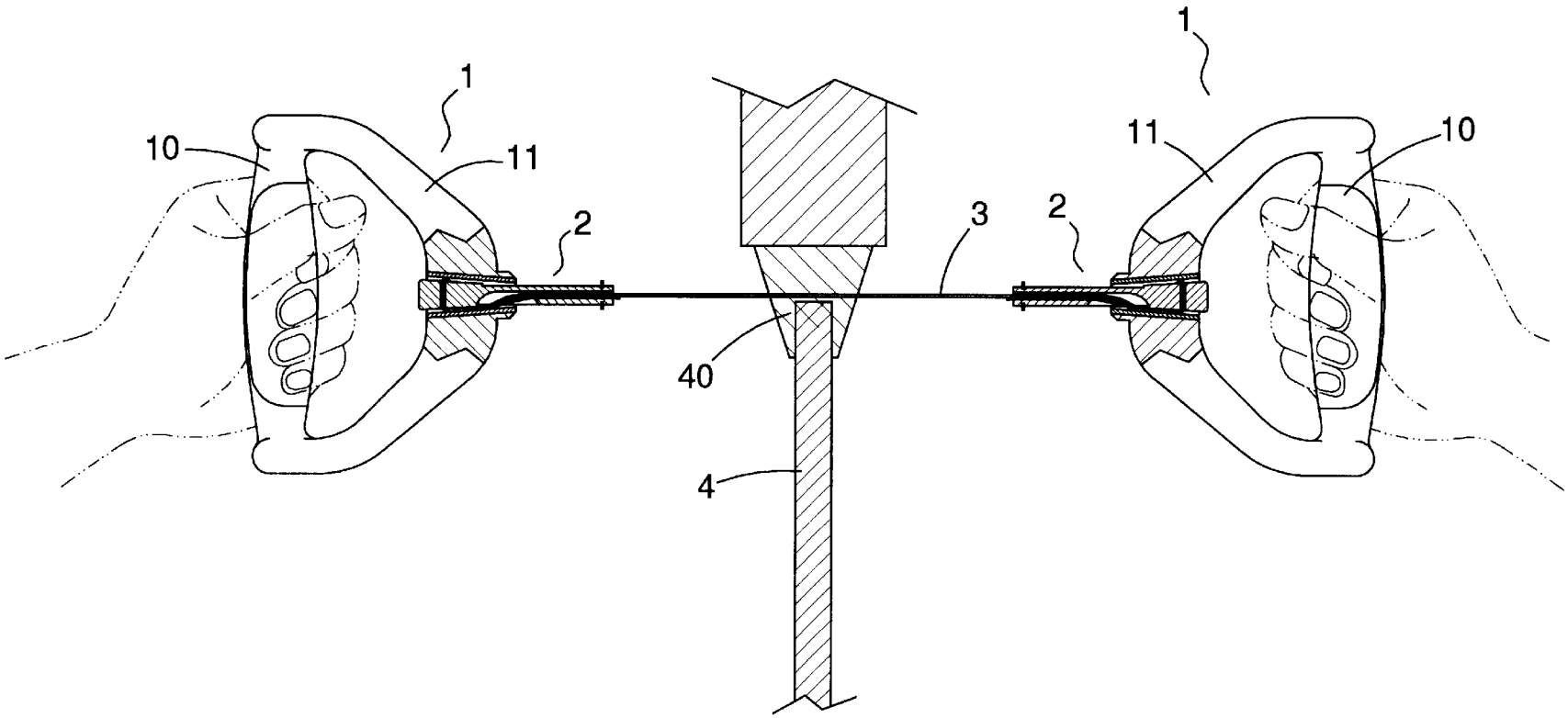
FIG. 4 is a schematic practice view of the string cutter in accordance with the preferred embodiment of the present invention.
Figure 5:
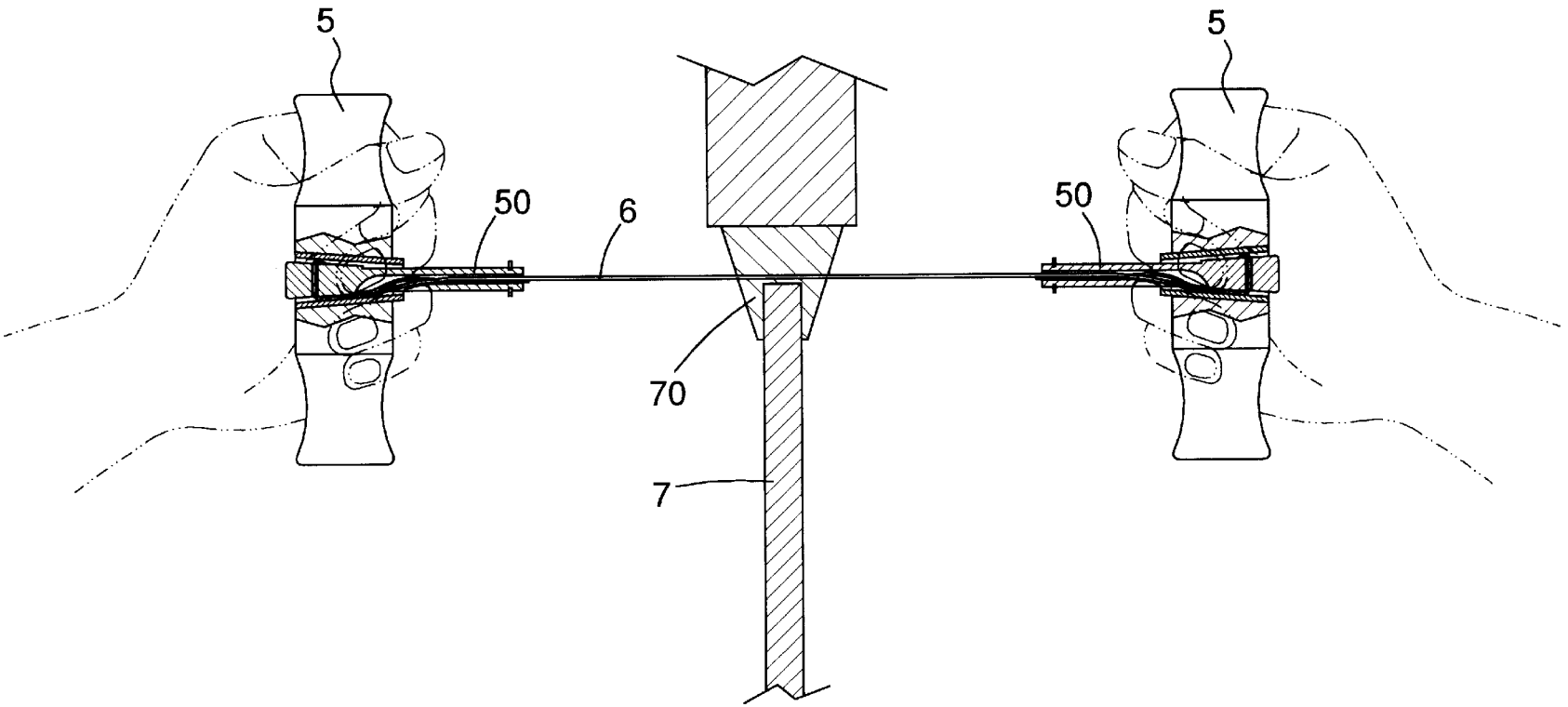
FIG. 5 (PRIOR ART)
FIG. 5 is a schematic practice view of a conventional string cutter in accordance with the prior art.

In operation, referring to FIG. 4, when the user wishes to detach the fixing silica gel 40 of the glass 4, the cutting string 3 is passed through the fixing silica gel 40 around the periphery of the glass 4. Then, each of the two ends of the cutting string 3 may be mounted and secured in the through hole 12 of the handgrip 10 of the respective handle 1 in the above-mentioned manner.

Thus, the user's two hands may hold the two handles 1 to exert a sideward force on the periphery of the glass 4, so that the cutting string 3 may produce a cutting force to cut the fixing silica gel 40 around the periphery of the glass 4. After the cutting string 3 is moved around a circle of the periphery of the glass 4, the fixing silica gel 40 around the periphery of the glass 4 may be cut off entirely, so that the glass 4 may be removed easily. It is appreciated that, the user's fingers are received in the loop-shaped handgrip 10 of each of the two handles 1, and may be protected by the protection rib 11 of each of the two handles 1, so that even when the cutting string 3 is broken due to wear or excessive pull and is sprung toward the handles 1, the cutting string 3 will be blocked and stopped by the protection rib 11 of each of the two handles 1, thereby efficiently preventing the broken cutting string 3 from injuring the user's fingers, so as to protect the user's safety.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A string cutter, comprising:

a pair of handles adapted to be held in the hands of a user, wherein each of said pair of handles includes a loop-shaped handgrip for insertion and holding of a user's fingers and is formed with a tapered through hole, said loop-shaped handgrip of each of the pair of handles having two sides that are each provided with a protection grip for encompassing and protecting the user's fingers received in the handgrip;

a pair of fixing devices releasably coupled to each of said handles and each including a fixing rod secured in the through hole of the handgrip of the respective handle, wherein each of said pair of fixing devices has a first end having an inner wall formed with a passage, a mediate portion having a periphery formed with an opening which communicates with the passage, and a second end provided with a tapered urging portion which is formed with a through hole; and a cutting string having opposing ends secured respectively to each of said handles by fixing said cutting string to each of said fixing devices.

2. The string cutter in accordance with claim 1, wherein the first end of the fixing rod of each of the fixing devices is protruded outward from the though hole of the handgrip of the respective handle, and has an outer wall formed with an annular groove for mounting a snap ring, thereby preventing the first end of the fixing rod of each of the fixing devices from detaching from the through hole of the handgrip of the respective handle.

3. The string cutter in accordance with claim 1, wherein the urging portion of each of the fixing devices has an outer diameter greater than that of the fixing rod of each of the fixing devices.

4. The string cutter in accordance with claim 1, wherein the tapered urging portion of each of the fixing devices is forced into the tapered through hole of the handgrip of the respective handle in a close fit manner, for clamping and securing the cutting string.

5. The string cutter in accordance with claim 1, wherein each of the two ends of the cutting string is secured on the handgrip of the respective handle by the urging portion of the respective fixing device.

6. The string cutter in accordance with claim 1, wherein each of the two ends of the cutting string is extended through the passage into the opening of the fixing rod of the respective fixing device, protruded outward from the opening of the fixing rod of the respective fixing device, extended through the through hole of the urging portion of the respective fixing device, and extended through the opening into the passage of the fixing rod of the respective fixing device, so that each of the two ends of the cutting string may be secured in the through hole of the handgrip of the respective handle by the urging portion of the respective fixing device.

* * * * *